US009655487B2

(12) United States Patent
Kim et al.

(10) Patent No.: US 9,655,487 B2
(45) Date of Patent: May 23, 2017

(54) VACUUM CLEANER AND NOZZLE FOR A VACUUM CLEANER

(71) Applicant: LG ELECTRONICS INC., Seoul (KR)

(72) Inventors: Seongjun Kim, Seoul (KR); Jinwoo Lee, Seoul (KR); Seogyong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/955,577

(22) Filed: Dec. 1, 2015

(65) Prior Publication Data

US 2016/0150928 A1 Jun. 2, 2016

(30) Foreign Application Priority Data

Dec. 1, 2014 (KR) ..... 10-2014-0169812
Dec. 10, 2014 (KR) ..... 10-2014-0177725

(51) Int. Cl.
*A47L 9/06* (2006.01)
*A47L 9/00* (2006.01)

(52) U.S. Cl.
CPC ..... *A47L 9/0633* (2013.01); *A47L 9/00* (2013.01); *A47L 9/066* (2013.01); *A47L 9/0673* (2013.01)

(58) Field of Classification Search
CPC ..... A47L 9/0633; A47L 9/00; A47L 9/066; A47L 9/0673; A47L 9/06; A47L 9/0653; A47L 9/068
See application file for complete search history.

(56) References Cited

U.S. PATENT DOCUMENTS 6,991,262 B1 * 1/2006 Ragner ..... A47L 9/06 15/417
2005/0081327 A1 * 4/2005 Lim ..... A47L 9/02 15/415.1
2005/0086764 A1 * 4/2005 Lim ..... A47L 9/02 15/415.1
2010/0294207 A1 * 11/2010 Dyson ..... A01K 13/00 119/611

FOREIGN PATENT DOCUMENTS

AT 413 789 B 6/2006
EP 2 253 258 11/2010
GB 2 407 260 A 4/2005
JP S57-196454 U1 12/1982
JP 2002-112930 A 4/2002
(Continued)

OTHER PUBLICATIONS

European Search Report issued in Application No. 15197313.8 dated Apr. 28, 2016.
(Continued)

*Primary Examiner* — Dung Van Nguyen
(74) *Attorney, Agent, or Firm* — KED & Associates, LLP

(57) ABSTRACT

A nozzle for a vacuum cleaner, including a suction part having a suction port and a main brush; and at least one movable member movably installed in the suction port and having a subsidiary brush. The at least one movable member may include a first and a second movable member provided at either side of the suction part, allowing a suction area of the nozzle to be selectively expanded.

20 Claims, 20 Drawing Sheets

(56) References Cited

FOREIGN PATENT DOCUMENTS

| | | | |
|---|---|---|---|
| KR | 10-1991-0002899 | B1 | 5/1991 |
| KR | 20-0312437 | Y1 | 5/2003 |
| KR | 10-0638205 | B1 | 10/2006 |
| KR | 10-0968335 | B1 | 7/2010 |
| KR | 10-2013-0023632 | A | 3/2013 |
| KR | 10-1450996 | B1 | 10/2014 |

OTHER PUBLICATIONS

Korean Office Action issued in Application No. 10-2014-0169812 dated Nov. 30, 2015.
Korean Office Action issued in Application No. 10-2014-0177725 dated Oct. 30, 2015.
European Search Report dated Sep. 8, 2016 issued in Application No. 15197313.8.

* cited by examiner

VACUUM CLEANER AND NOZZLE FOR A VACUUM CLEANER

CROSS-REFERENCE TO RELATED APPLICATION(S)

This application claims priority under 35 U.S.C. §119 to Korean Application No. 10-2014-0169812, filed in Korea on Dec. 1, 2014 and Korean Application No. 10-2014-0177725, filed in Korea on Dec. 10, 2014, whose entire disclosures are hereby incorporated by reference.

BACKGROUND

1. Field

A vacuum cleaner and a nozzle for a cleaner are disclosed herein.

2. Background

Generally, a vacuum cleaner is an apparatus which suctions air containing dust using a suction force generated from a suction motor installed inside a main body of the cleaner and then filters the dust in a dust separator. The vacuum cleaner may be classified as a canister type in which a suction nozzle for suctioning the dust may be provided separately from the main body and connected through a connector, or an up-right type in which the suction nozzle may be rotatably connected with the main body. Meanwhile, a nozzle for a vacuum cleaner is disclosed in Korean Patent Publication No. 10-2013-0023632 as a related art document whose disclosure is hereby incorporated by reference.

The nozzle for the vacuum cleaner may include a nozzle body having a suction port, a nozzle cover formed above the nozzle body, and a brush provided at the nozzle body to come in contact with a floor surface and stir up foreign substances. The nozzle for the vacuum cleaner may serve to stir up the foreign substances on the floor surface using the brush and then to suction the foreign substances into the suction port.

Meanwhile, in the case of the cleaner disclosed in the related art document, an area of the suction nozzle having the brush is fixed, and thus there may be a problem that a cleanable area is limited. Also, in the case of the cleaner disclosed in the related art document, when hairs, pet hairs, or the like are attached to the brush, it may be inconvenient for a user to directly remove them. To solve this problem, the cleaner of the related art document has an air jet for cleaning the foreign substances attached to the brush. However, although the air jet may separate the foreign substances consisting of small particles, such as dust, it cannot easily separate the hairs, the pet hairs or the like.

BRIEF DESCRIPTION OF THE DRAWINGS

Embodiments will be described in detail with reference to the following drawings in which like reference numerals refer to like elements, and wherein.

DETAILED DESCRIPTION

Figure 1:
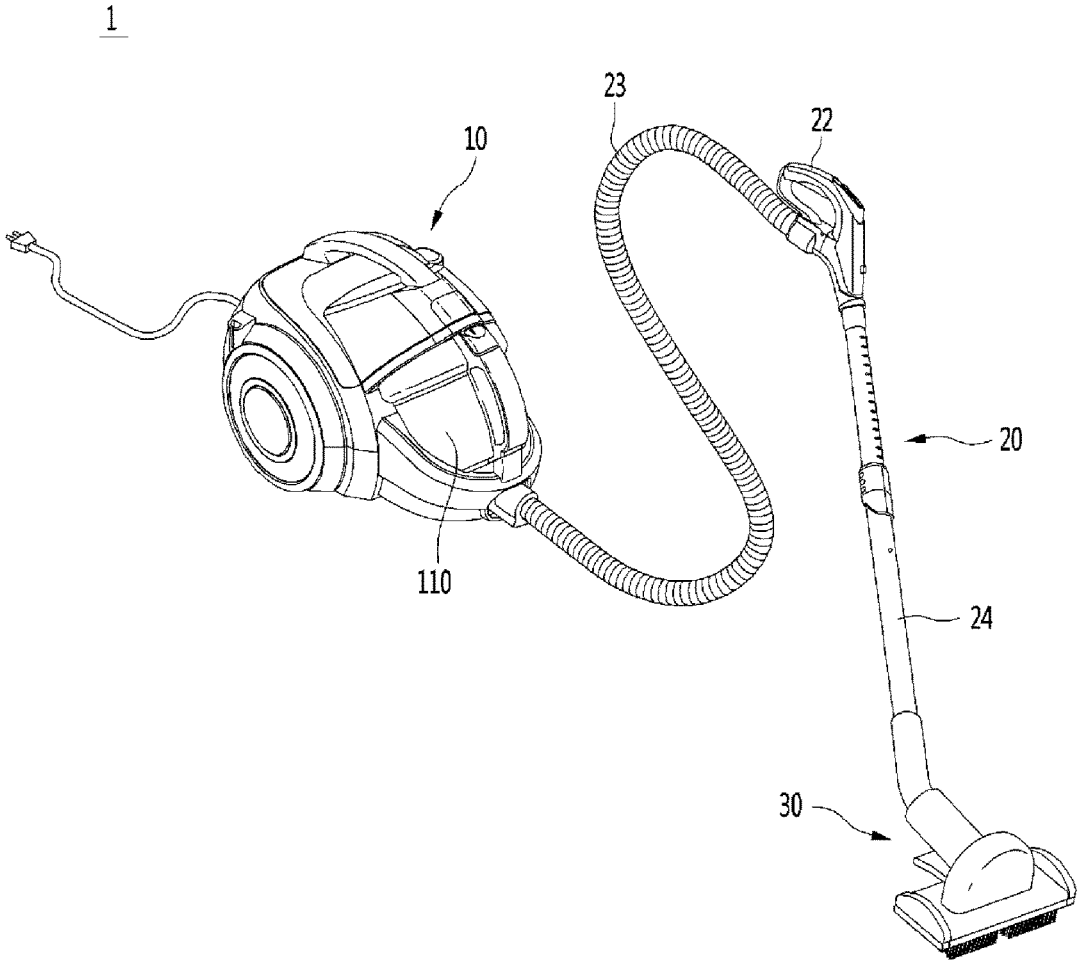
FIG. 1 is a perspective view of a vacuum cleaner according to an embodiment.
Figure 2:
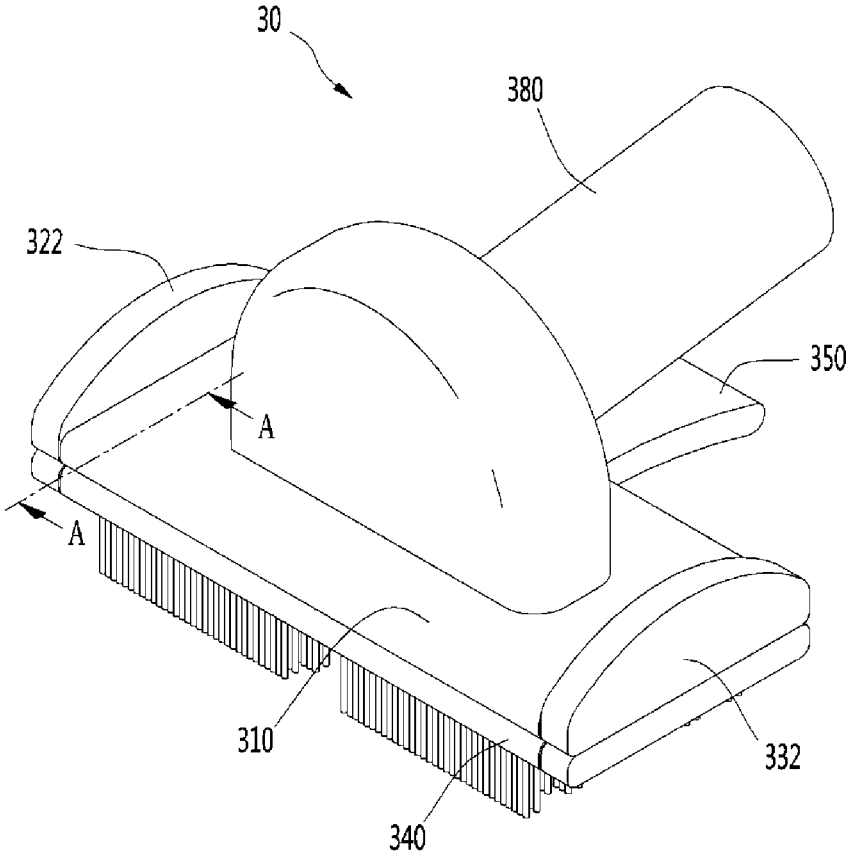
FIG. 2 is a view illustrating a suction nozzle of FIG. 1 in detail.
Figure 3:
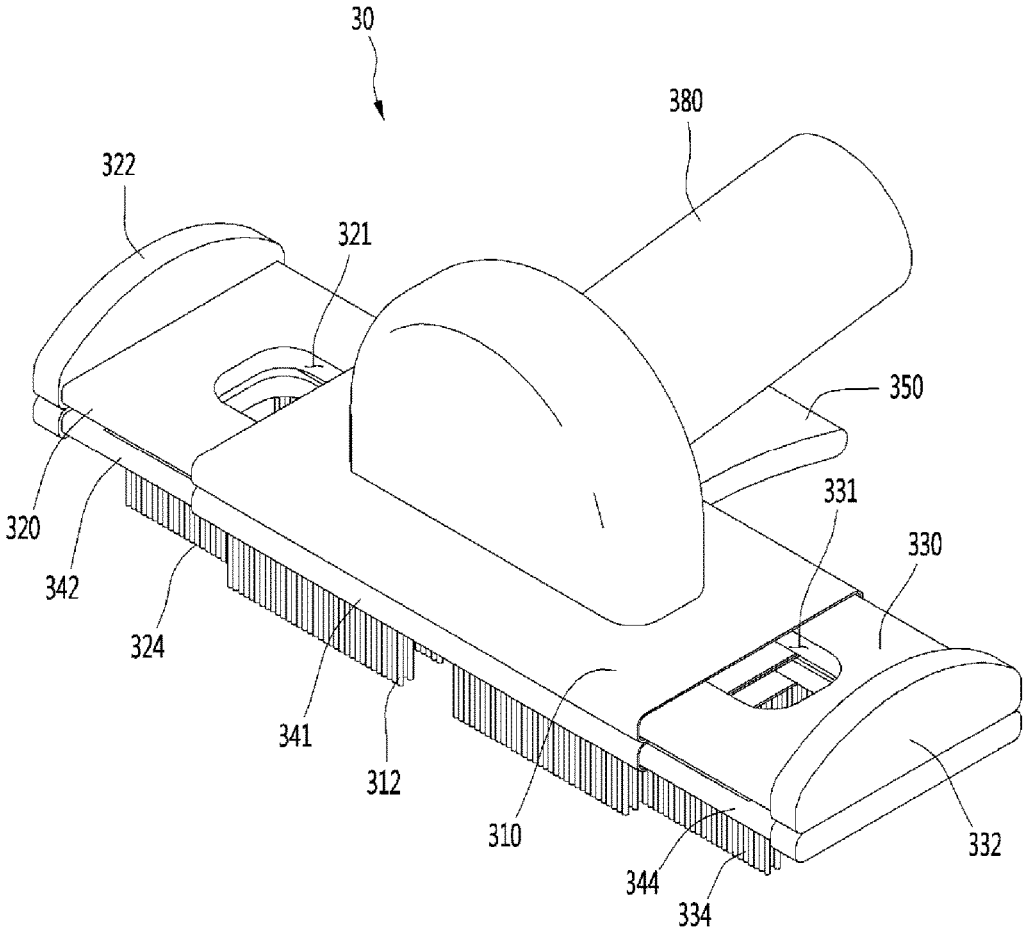
FIG. 3 is a view illustrating a state in which a movable member of the suction nozzle of FIG. 2 is withdrawn.
Figure 4:
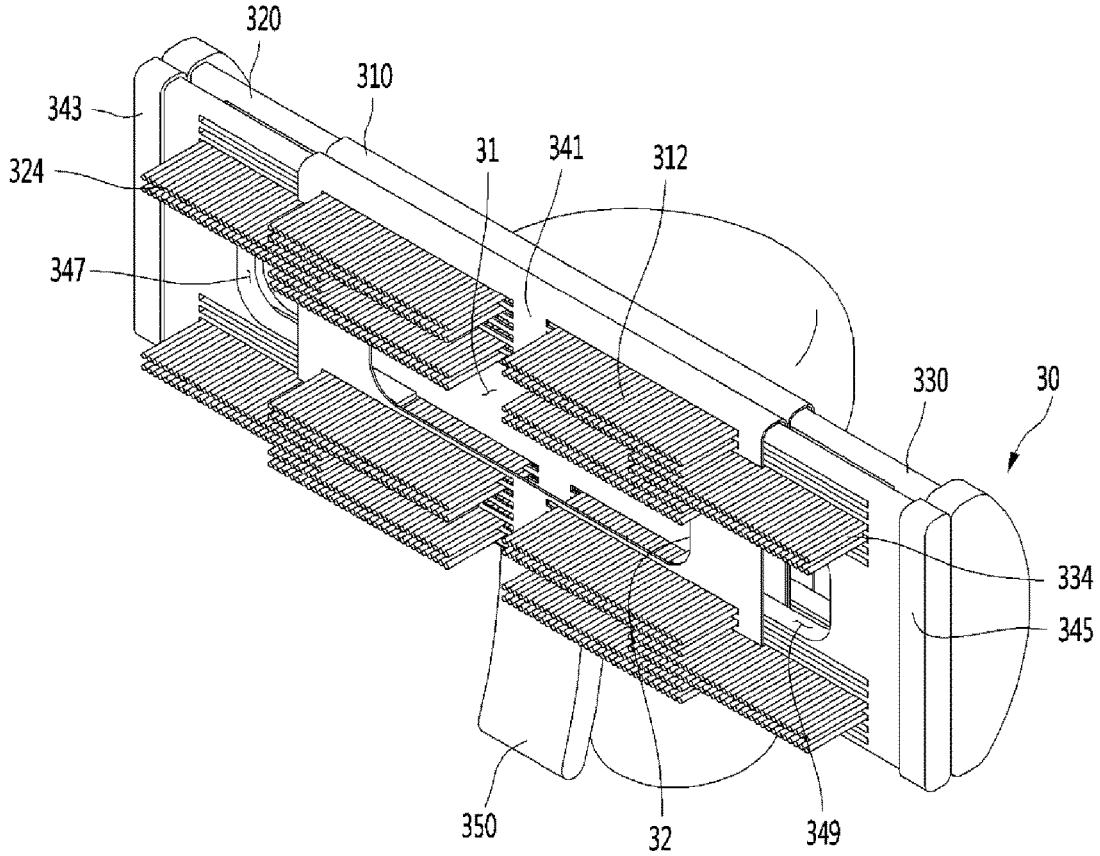
FIG. 4 is a bottom view of the suction nozzle of FIG. 3.

FIG. 1 is a perspective view of a vacuum cleaner according to embodiment, FIG. 2 is a view illustrating a suction nozzle of FIG. 1 in detail, FIG. 3 is a view illustrating a state in which a movable member of the suction nozzle of FIG. 2 is withdrawn, and FIG. 4 is a bottom view of the suction nozzle of FIG. 3. FIG. 1 illustrates a canister type vacuum cleaner. However, a suction nozzle may also be applied to an up-right type vacuum cleaner. Also, in the specification, a "floor surface" may be a surface to be cleaned, such as a carpet or non-carpeted surface flooring (e.g., wood floors).

Referring to FIGS. 1 to 4, a vacuum cleaner 1 according to an embodiment may include a cleaner body 10 having a suction motor (not shown) which may generate a suction force, and a suction unit or device 20 which may be connected to the cleaner body 10 to suction air and foreign substances on a floor surface. The cleaner body 10 may include one or more wheels, and a dust container 110 in which dust separated from the air is stored. The suction unit 20 may include a suction nozzle 30 which may be movable along the floor surface, and a connection mechanism which may connect the suction nozzle 30 with the cleaner body 10.

The connection mechanism may include an extension tube 24 which may be connected to the suction nozzle 30, a handle 22 which may be connected to the extension tube 24, and a connection hose 23 which may connect the handle 22 with the cleaner body 10. The suction nozzle 30 may include a suction part 310, and one or more movable members 320 and 330 which may be movably connected to the suction part 310. The one or more movable members 320 and 330 may be provided so as to be inserted into or withdrawn from the suction part 310.

The suction nozzle 30 may further include a connection tube 380 which may be rotatably connected to a rear portion of the suction part 310. The extension tube 24 may be connected to the connection tube 380. A suction port 31 may be formed at the suction part 310, and the foreign substances suctioned through the suction port 31 may be moved to the dust container 110 of the cleaner body 10 through the connection tube 380 and the extension tube 24.

First communication holes 321 and 331 may be provided at the one or more movable members 320 and 330. While the movable members 320 and 330 may be inserted into the suction part 310, the first communication holes 321 and 331 may be aligned with the suction port 31. That is, the air may pass through the suction port 31 via the first communication holes 321 and 331.

FIG. 2 illustrates an example in which two movable members 320 and 330 are connected to both sides of the suction part 310. In an embodiment, the number of movable members 320 and 330 may not be limited. The movable members 320 and 330 may include a first movable member 320 which may be connected to a first side of the suction part 310, and a second movable member 330 which may be connected to a second side of the suction part 310.

Each of the first movable member 320 and the second movable member 330 may be connected to the suction part 310 to be inserted therein or withdrawn therefrom. For example, each of the first movable member 320 and the second movable member 330 may be slidingly inserted into the suction part 310 or withdrawn from the suction part 310. That is, a user may grip and then manually withdraw one or more of the first movable member 320 and the second movable member 330. The first movable member 320 and the second movable member 330 may be withdrawn from the suction part 310 away from each other, and may be inserted into the suction part 310 toward each other.

The first movable member 320 and the second movable member 330 may be independently withdrawn from or inserted into the suction part 310. That is, one of the first movable member 320 and the second movable member 330 may be withdrawn from the suction part 310, or both of the first movable member 320 and the second movable member 330 may be withdrawn from the suction part 310. The first movable member 320 and the second movable member 330 may have the same structure as each other. However, lengths of the first movable member 320 and the second movable member 330 may be the same as or different from each other.

When the lengths of the first movable member 320 and the second movable member 330 are different from each other, a maximum withdrawn length of the first movable member 320 withdrawn from the suction part 310 may be different than a maximum withdrawn length of the second movable member 330 withdrawn from the suction part 310. However, in a state in which the first movable member 320 and the second movable member 330 have the same length, lengths when they are withdrawn from the suction part 310 may be different from each other.

The first movable member 320 and the second movable member 330 may respectively have stoppers 322 and 332 which come into contact with side ends of the suction part 310 when they are inserted into the suction part 310. The stoppers 322 and 332 may include a first stopper 322 which may be provided at the first movable member 320, and a second stopper 332 which may be provided at the second movable member 330. A main brush 312 for cleaning the floor surface may be provided at the suction part 310. The main brush 312 may be formed to protrude downward from a lower surface of the suction part 310.

One or more of the first movable member 320 and the second movable member 330 may further include subsidiary brushes 324 and 334 for cleaning the floor surface. The subsidiary brushes 324 and 334 may include a first subsidiary brush 324 which may be provided at or in the first movable member 320, and a second subsidiary brush 334 which may be provided at or in the second movable member 330. The main brush 312 and the subsidiary brushes 324 and 334 may be commonly referred to as brushes 312, 324 and 334. Since the movable members 320 and 330 are inserted into an internal space of the suction part 310, the subsidiary brushes 324 and 334 may pass through the lower surface of the suction part 310.

The suction part 310 may include a first brush slit 314 (referring to FIG. 7) which may prevent interference with the subsidiary brushes 324 and 334 while the movable members 320 and 330 may be inserted into the suction part 310. That is, when the movable members 320 and 330 are inserted into the suction part 310, the subsidiary brushes 324 and 334 may be located in the first brush slit 314 (referring to FIG. 7).

In an embodiment, when each of the first movable member 320 and the second movable member 330 is withdrawn from the suction part 310, an area of the floor surface with which the brushes come in contact may be increased. The suction nozzle 30 may further include a brush cleaning unit or device 340 which may remove foreign substances, such as hairs, attached to the main brush 312 or the subsidiary brushes 324 and 334. The brush cleaning unit 340 may be moved in the same direction as an extension direction of the main brush 312 and the subsidiary brushes 324 and 334, and may clean the foreign substances attached to the main brush 312 and the subsidiary brushes 324 and 334.

The suction nozzle 30 may further include a lever 350 which may operate the brush cleaning unit 340. When the user pulls the lever 350, the brush cleaning unit 340 may be moved by the lever 350 in the same direction as the extension direction of the main brush 312 and the subsidiary brushes 324 and 334. Also, the lever 350 may further include a transmission part (not shown) which may transmit a force applied to the lever 350 to the brush cleaning unit 340 and move the brush cleaning unit 340. In this case, the transmission part (not shown) may move the brush cleaning unit 340 with the force transmitted from the lever 350.

The brush cleaning unit 340 may include a first cleaning part 341, and second and third cleaning parts 342 and 344, which may be connected to the first cleaning part 341 to be inserted thereinto or withdrawn therefrom. Each of the second cleaning part 342 and the third cleaning part 344 may be slidingly inserted into or withdrawn from the first cleaning part 341. The first cleaning part 341 may include an opening 32 which may be in communication with the suction port 31. The second cleaning part 342 and the third cleaning part 344 may include second communication holes 347 and 349 which may be in communication with the first communication holes 321 and 331, respectively.

The second cleaning part 342 and the third cleaning part 344 may include stoppers 343 and 345, respectively. The stoppers 343 and 345 may come into contact with side ends of the first cleaning part 341 while the second cleaning part 342 and the third cleaning part 344 may be inserted into the first cleaning part 341. The stoppers 343 and 345 may include a third stopper 343 which may be installed at the second cleaning part 342, and a fourth stopper 345 which may be installed at the third cleaning part 344.

Figure 5:
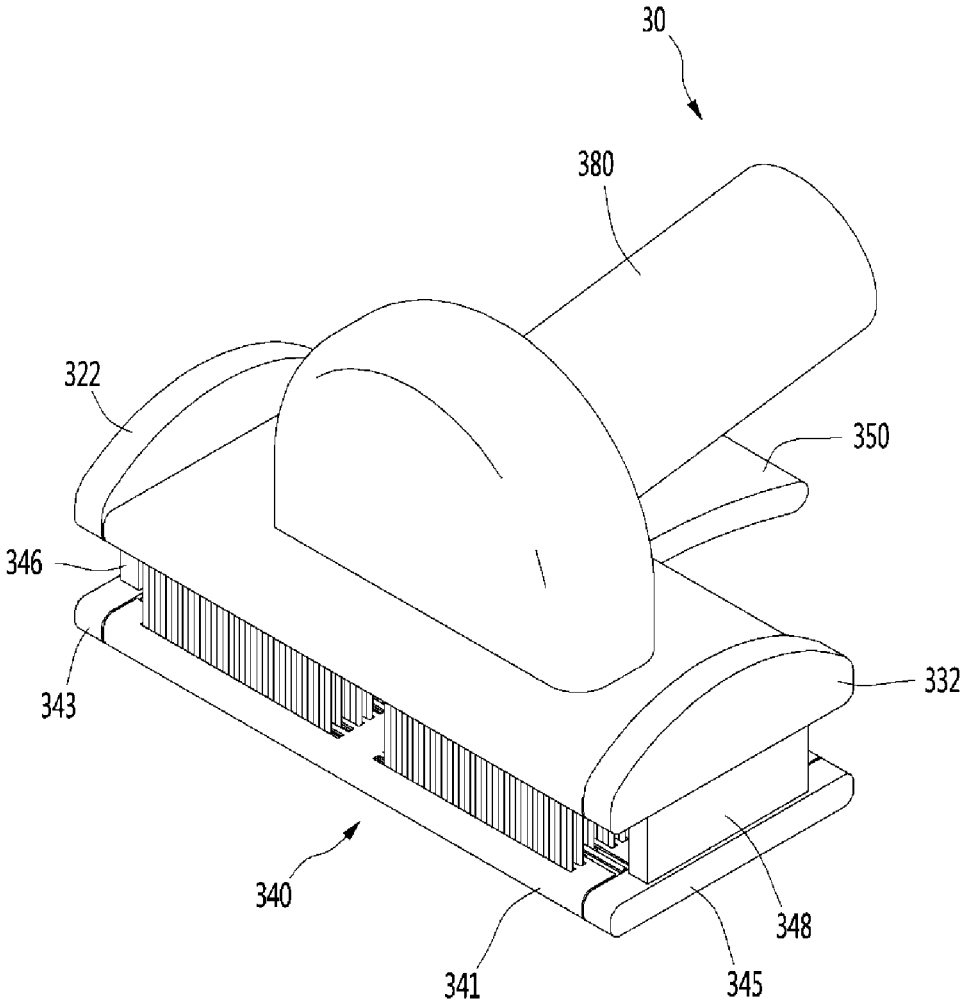
FIG. 5 is a view illustrating a state in which a brush cleaning unit of FIG. 2 is moved down.
Figure 6:
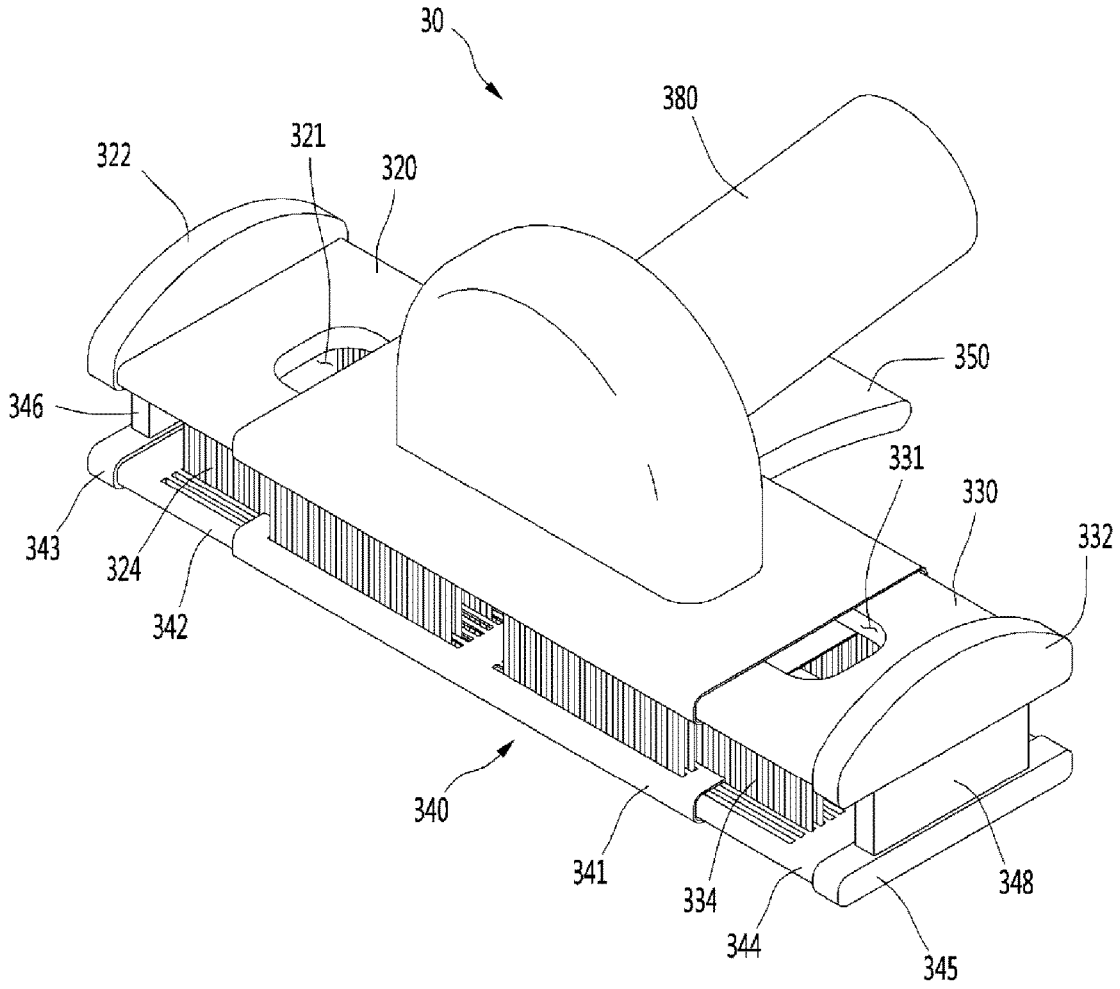
FIG. 6 is a view illustrating a state in which the movable member of the suction nozzle of FIG. 5 is withdrawn.

Hereinafter, a case in which the brush cleaning unit 340 is moved down along the brushes 312, 324 and 334 will be described in detail. FIG. 5 is a view illustrating a state in which the brush cleaning unit of FIG. 2 is moved down, and FIG. 6 is a view illustrating a state in which the movable member of the suction nozzle of FIG. 5 is withdrawn. Referring to FIGS. 5 and 6, the second cleaning part 342 and the third cleaning part 344 may further include guide parts 346 and 348 that may couple to the movable members, respectively. The guide parts 346 and 348 may include a first guide part 346 which may be formed to protrude upward from the third stopper 343 provided at the brush cleaning unit 340, and a second guide part 348 which may be formed to protrude upward from the fourth stopper 345.

The first guide part 346 and the second guide part 348 may be inserted into the stoppers 322 and 332 of the movable members 320 and 330, respectively. For example, the first guide part 346 may be inserted into the first stopper 322, and the second guide part 348 may be inserted into the second stopper 332. As such, since the second cleaning part 342 and the third cleaning part 344 may be fixed to the first movable member 320 and the second movable member 330, respectively, the second cleaning part 342 may be moved with the first movable member 320, and the third cleaning part 344 may be moved with the second movable member 330. That is, as the movable members 320 and 330 are moved, a length of the brush cleaning unit 340 may be varied.

The guide parts 346 and 348 may be provided with guide part stoppers (not shown) which may prevent the guide parts 346 and 348 from being moved down beyond a predetermined distance. Accordingly, distance to which the brush cleaning unit 340 can move downward may be limited. The guide parts 346 and 348 may be provided at the first stopper 322 and the second stopper 332, instead of the third stopper 343 and the fourth stopper 345.

Figure 7:
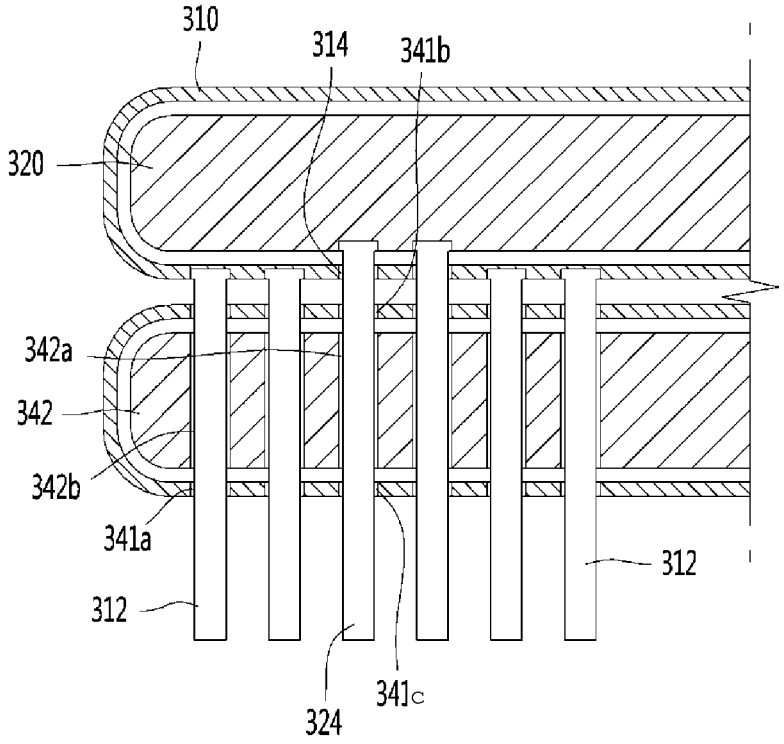
FIG. 7 is a cross-sectional view taken along A-A' of FIG. 2.
Figure 8:
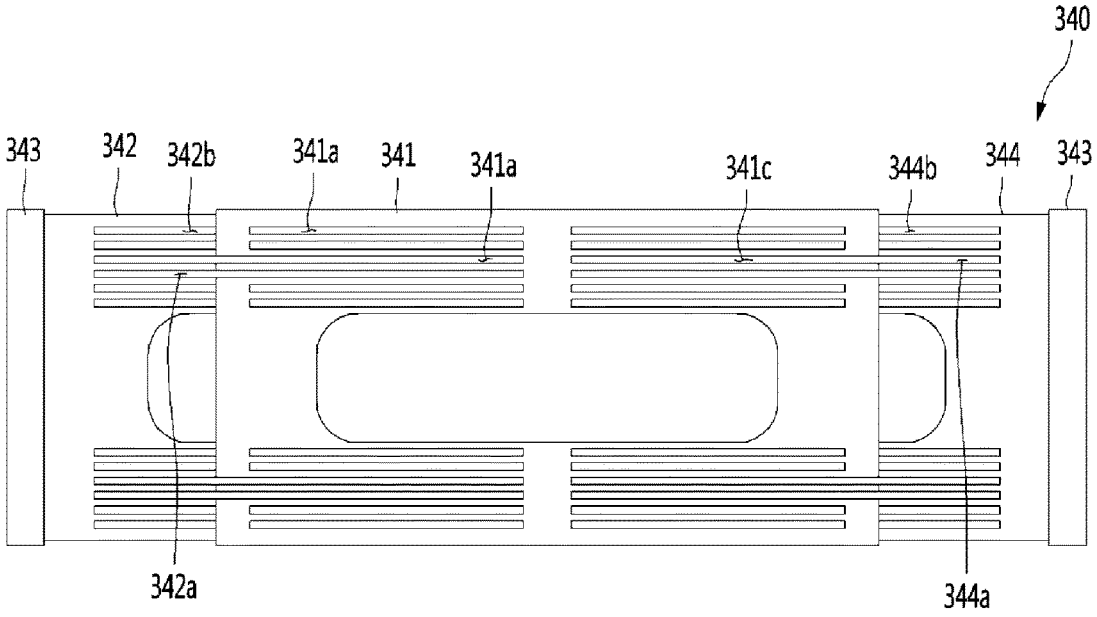
FIG. 8 is a bottom view of the brush cleaning unit of FIG. 4.

Hereinafter, a coupling structure among the suction part 310, the movable members 320 and 330 and the brush cleaning unit 340 will be described in detail. FIG. 7 is a cross-sectional view taken along A-A' of FIG. 2, and FIG. 8 is a bottom view of the brush cleaning unit of FIG. 4. Referring to FIGS. 7 and 8, the first movable member 320 may be inserted into the internal space of the suction part 310. The first movable member 320 may be slidingly moved into the internal space of the suction part 310, while the first subsidiary brush 324 passes through the suction part 310 and the brush cleaning unit 340.

The first cleaning part 341 may include a first brush hole 341*a* through which the main brush 312 passes. The main brush 312 may be inserted into the first brush hole 341*a*, and may be fixed to the first cleaning part 341. The first brush hole 341*a* may be formed at upper and lower portions of the first cleaning part 341. The first cleaning part 341 may also include second brush slits 341*b* and 341*c* which may prevent interference with the subsidiary brushes 324 and 334 when the movable members 320 and 330 may be inserted into or withdrawn from the suction part 310. That is, the subsidiary brushes 324 and 334 may be moved along the second brush slits 314*b* and 341*c* while the movable members 320 and 330 may be inserted into the suction part 310. The second brush slits 341*b* and 341*c* may be formed at upper and lower ends of the first cleaning part 341.

The second cleaning part 342 and the third cleaning part 344 may include second brush holes 342*a* and 344*a* through which the subsidiary brushes 324 and 334 pass. The subsidiary brushes 324 and 334 may be inserted into the second brush holes 342*a* and 344*a*, and may be fixed to the second cleaning part 342 and the third cleaning part 344. The second cleaning part 342 and the third cleaning part 344 may also include third brush slits 342*b* and 344*b* which may prevent interference with the main brush 312 during insertion into or withdrawal from the first cleaning part 341. That is, when the second cleaning part 342 and the third cleaning part 344 are inserted into the first cleaning part 341, the main brush 312 may be located in the third brush slits 342*b* and 344*b*.

Hereinafter, an operation of the suction nozzle 30 will be described with reference to FIGS. 2 to 8. First, as illustrated in FIG. 2, when the movable members 320 and 330 are inserted into the suction part 310, the opening 32 of the first cleaning part 341, the second communication holes 347 and 349 of the second cleaning part 342 and the third cleaning part 344, the first communication holes 321 and 331 of the movable members 320 and 330, and the suction port 31 of the suction part 310 may be aligned with each other. The air containing the dust may be suctioned into the suction port 31 through the opening 32, the second communication holes 347 and 349, and the first communication holes 321 and 331 by the suction force generated by the suction motor.

As illustrated in FIG. 2, in a state in which the brush cleaning unit 340 is not moved down, the main brush 312 and the subsidiary brushes 324 and 334 may protrude below the brush cleaning unit 340. As such, the surface to be cleaned may be cleaned by the main brush 312 and the subsidiary brushes 324 and 334 which protrude below the brush cleaning unit 340. As illustrated in FIG. 3, when the movable members 320 and 330 are withdrawn from the suction part 310, the length of the brush cleaning unit 340 may be increased. That is, the second cleaning part 342 and the third cleaning part 344 which may be connected to the movable members 320 and 330 may be withdrawn from the first cleaning part 341 along with the movable members 320 and 330.

In this case, a transverse width of an area to be cleaned which may be cleaned by the main brush 312 and the subsidiary brushes 324 and 334 may be increased. In a state illustrated in FIG. 3, the brush cleaning unit 340 may be moved down, as illustrated in FIG. 5. While the brush cleaning unit 340 is being moved down as illustrated in FIG. 5, the brush cleaning unit 340 may remove the foreign substances or the hairs attached to the main brush 312 and the subsidiary brushes 324 and 334 from the main brush 312 and the subsidiary brushes 324 and 334. That is, in a state in which the brush cleaning unit 340 is in contact with the suction part 310, the brush cleaning unit 340 may be moved toward ends of the main brush 312 and the subsidiary brushes 324 and 334 and move the foreign substances attached to the main brush 312 and the subsidiary brushes 324 and 334 away from the main brush 312 and the subsidiary brushes 324 and 334, and thus the foreign substances may be removed from the main brush 312 and the subsidiary brushes 324 and 334.

Although not shown in the drawings, in a state in which the movable members 320 and 330 are withdrawn as illustrated in FIG. 4, the brush cleaning unit 340 may be moved down, and may remove the foreign substances or the hairs attached to the main brush 312 and the subsidiary brushes 324 and 334. As described above, the brush cleaning unit 340 may reciprocate between upper ends and lower ends of the brushes 312, 324 and 334 while the brushes 312, 324 and 334 pass therethrough, and thus the foreign substances attached to the brushes 312, 324 and 334 may be removed. Accordingly, cleaning efficiency by the brushes 312, 324 and 334 may be increased. Also, when the movable members 320 and 330 are inserted into or withdrawn from the suction part 310, the brush cleaning unit 340 may extend along with the movable members 320 and 330. Therefore, the brush cleaning unit 340 may be used in a nozzle of a cleaner which may have a variable length.

Figure 9:
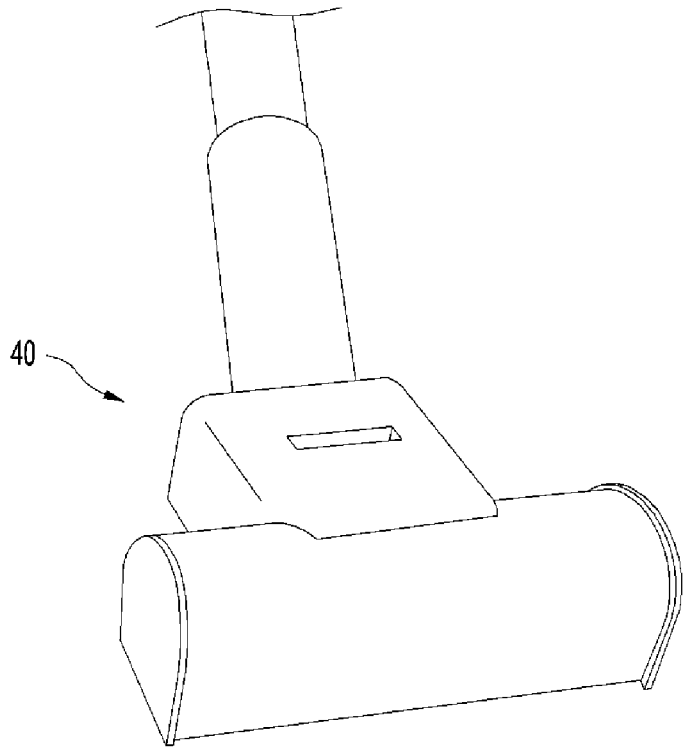
FIG. 9 is a perspective view of a suction nozzle according to an embodiment.
Figure 10:
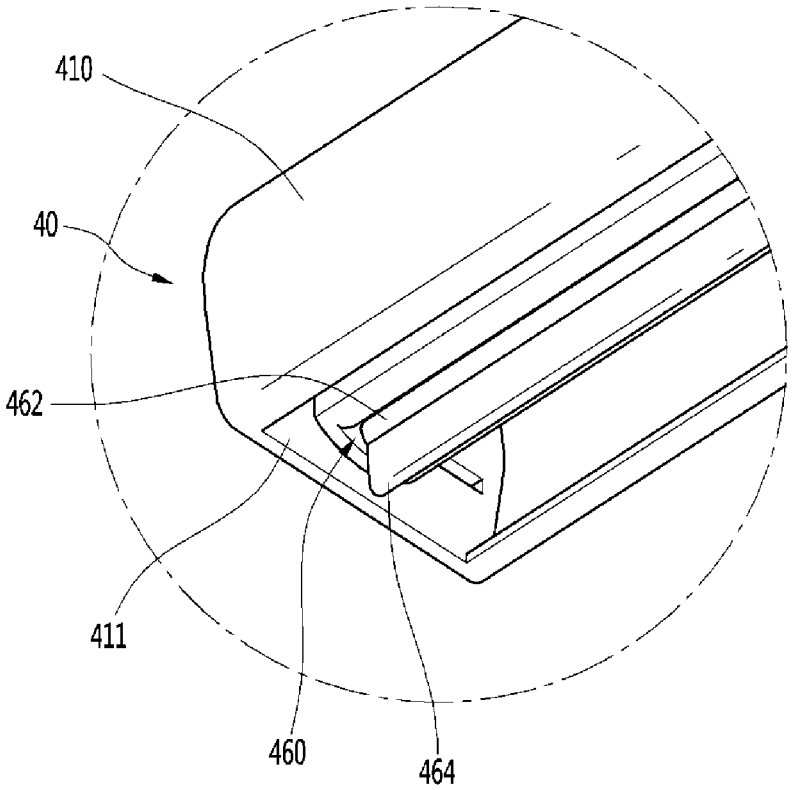
FIG. 10 is a perspective view illustrating a lower structure of the suction nozzle according to an embodiment.
Figure 11:
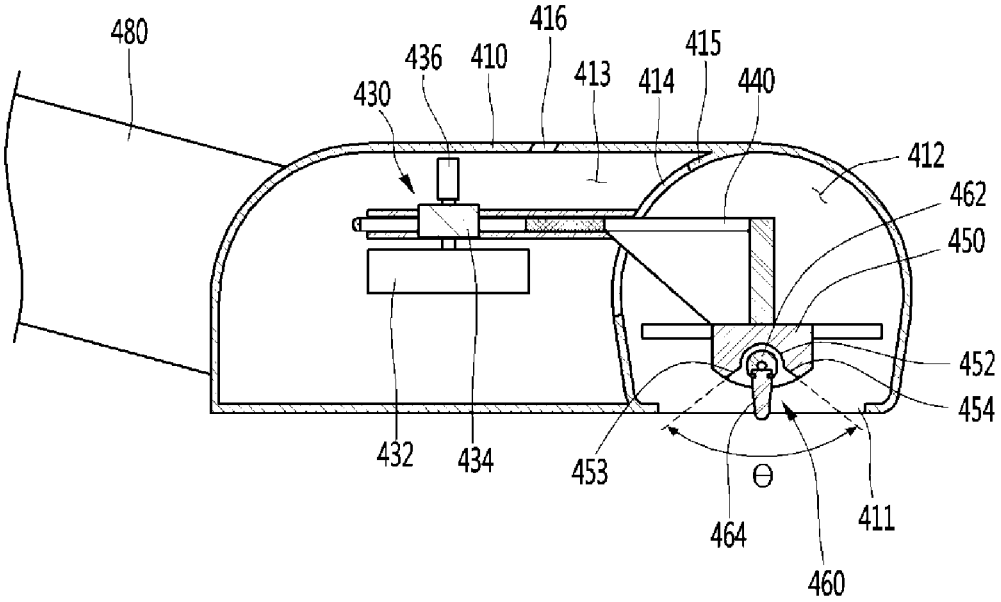
FIG. 11 is a cross-sectional view illustrating an internal structure of the suction nozzle according to an embodiment.

FIG. 9 is a perspective view of a suction nozzle according to an embodiment, FIG. 10 is a perspective view illustrating a lower structure of the suction nozzle according to an embodiment, and FIG. 11 is a cross-sectional view illustrating an internal structure of the suction nozzle according to an embodiment. Referring to FIGS. 9 to 11, the suction nozzle 40 may include a nozzle body 410 having a suction port 411 that may suction air containing dust. For example, the suction port 411 may be formed at a bottom of the nozzle body 410, and may be formed to extend to the left and right of the nozzle body 410.

The suction nozzle 40 may further include a connection tube 480 which may be connected to a rear side of the nozzle body 410. The connection tube 480 may be rotatably connected to the nozzle body 410. The suction nozzle 40 may further include a cleaning part 460 that may clean the floor surface, and a drive unit or module 430 drive the cleaning part 460.

The cleaning part 460 may include a cleaning body 462, and a brush member 464 which may be provided at the cleaning body 462. The brush member 464 may include a brush or may be formed of a rubber material. The brush member 464 may slide along the floor surface and sweep up dust on the floor surface. The brush member 464 may be slidingly coupled to the cleaning body 462. The drive unit 430 may drive the cleaning part 460 so that the brush member 464 of the cleaning part 460 may reciprocate within a predetermined range. For example, the drive unit 430 may drive the cleaning part 460 so that the brush member 464 of the cleaning part 460 may perform a pendulum motion within a predetermined angular range which is smaller than 360 degrees.

The drive unit 430 may include a drive part or component 432 which may generate a driving force, and a power transmission part which may transmit the driving force of the driving part 432 to the cleaning part 460. For example, the drive part 432 may be a motor. The power transmission part may serve to convert a rotational force generated by the motor into a linear motion. The power transmission part may include a rotational part 434 which may be connected to the drive part 432, and a movable member 440 which receives the driving force of the drive part 432 from the rotational part 434.

The movable member 440 may receive a rotational force from the rotational part 434 and may perform the linear motion. The rotational part 434 may be rotatably connected to a fixed shaft 436 which may be fixed to the nozzle body 410. A shaft of the motor may be connected to the rotational part 434. The drive part 432 may be fixed to the nozzle body 410 by the fixed shaft 436. Alternatively, a support port for supporting the drive part 432 may be provided at the nozzle body 410. Alternatively, the shaft of the motor may pass through the rotational part 434, and may be connected to the fixed shaft 436.

The nozzle body 410 may include a first chamber 412 in which the cleaning part 460 is located, and a second chamber 413 in which the drive part 432 is located. The first chamber 412 and the second chamber 413 may be divided by a partition wall 415. The partition wall 415 may have an opening 414 through which a first space 412 may communicate with a second space 413. The movable member 440 may pass through the opening 414. Alternatively, the partition wall 415 may be removed from the nozzle body 410. In this case, a single chamber may be formed in the nozzle body 410.

The cleaning part 460 may be rotatably connected to the movable member 440. That is, the cleaning part 460 may be connected to the movable member 440 in an idle state. An accommodation part 452 in which the cleaning part 460 is located may be provided at the movable member 440. The accommodation part 452 may be provided at a lower portion of the movable member 440. The movable member 440 may include a first limiting surface 453 and a second limiting surface 454 which may limit a rotational range of the brush member 464 when the brush member 464 performs the pendulum motion.

The first limiting surface 453 and the second limiting surface 454 may be provided to be farther apart from each other toward a bottom of the accommodation part 452. An angle θ between the first limiting surface 453 and the second limiting surface 454 may be less than 135 degrees. When the angle between the first limiting surface 453 and the second limiting surface 454 is more than the 135 degrees, there may be a problem that a length of the suction port in a forward and backward direction may need to be increased to prevent interference with the brush member 464 due to an increase in an angle of the pendulum motion of the brush member 464. Also, since a distance of a linear motion of the movable member may need to be increased, there may be another problem that a size of the suction nozzle may need to be increased. Therefore, it is preferable that the angle θ between the first limiting surface 453 and the second limiting surface 454 be less than 135 degrees.

The brush member 464 of the cleaning part 460 may reciprocate within an angular range between the first limiting surface 453 and the second limiting surface 454. In a state in which the cleaning part 460 may be installed at the movable member 440, a lower end of the cleaning part 460, e.g., a lower end of the brush member 464, may pass through a lower side of the suction port 411, and may protrude from the lower side of the suction port 411. A subsidiary suction port 416 through which the air may be suctioned may be provided at an upper portion of the nozzle body 410. The air suctioned through the subsidiary suction port 416 may flow to a connection portion between the rotational part 434 and the movable member 440.

In a state in which the rotational part 434 may be connected to the movable member 440, when fine dust or sand may be at the connection portion, the rotational part 434 may not rotate smoothly, or the movable member 440 may not perform the linear motion smoothly. Therefore, in an embodiment, since the subsidiary suction port 416 is formed at the nozzle body 410, the fine dust or the sand may be removed from the connection portion by the air suctioned through the subsidiary suction port 416.

Figure 12:
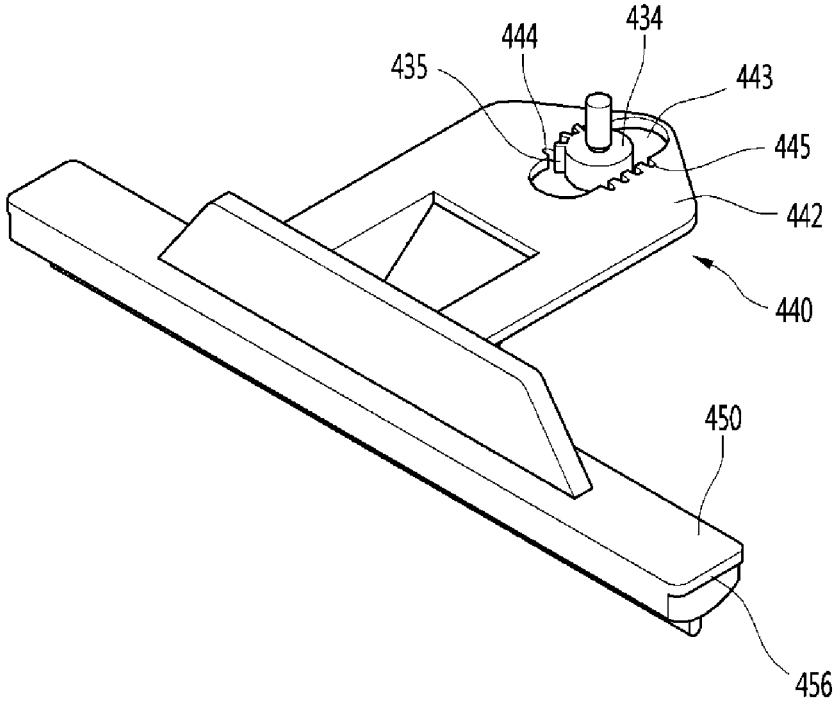
FIG. 12 is a perspective view of a power transmission part according to an embodiment.

Hereinafter, a structure of the power transmission part will be described in detail. FIG. 12 is a perspective view of the power transmission part according to an embodiment. Referring to FIGS. 11 and 12, the movable member 440 may include a first member 442 which may extend horizontally, and a second member 450 which may extend downward from the first member 442. For example, the second member 450 may extend downward from one end of the first member 442. The first member 442 may pass through the opening 414 of the partition wall 415. The cleaning part 460 may be rotatably connected to the second member 450.

An accommodation part 443 in which the rotational part 434 may be accommodated may be provided at the first member 442. The accommodation part 443 may be a slit or a groove. When the accommodation part 443 is a groove, the groove may be formed by recessing an upper surface of the first member 442 downward.

The rotational part 434 may have a plurality of gear teeth 435 which are formed within a predetermined angular range in a circumferential direction. That is, the rotational part 434 may be a partial gear in which the gear teeth are formed at a part thereof. The accommodation part 443 may include a first gear part 444 and a second gear part 445. The first gear part 444 and the second gear part 445 may be disposed to face each other, and each of the first gear part 444 and the second gear part 445 may include the plurality of gear teeth.

At this time, the plurality of gear teeth in each of the first gear part 444 and the second gear part 445 may be disposed linearly. Therefore, the first gear part 444 and the second gear part 445 may serve as rack gears, and the rotational part 434, i.e., the partial gear, may serve as a pinion gear. The rotational part 434 may be rotated in a first direction. While the rotational part 434 is rotated in the first direction, the gear teeth 435 of the rotational part 434 may be engaged with the first gear part 444, and may move the movable member 440 in the first direction, and when the rotational part 434 is further rotated in the first direction, the gear teeth 435 of the rotational part 434 may be engaged with the second gear part 445, and may move the movable member 440 in a second direction opposite to the first direction.

Figure 13:
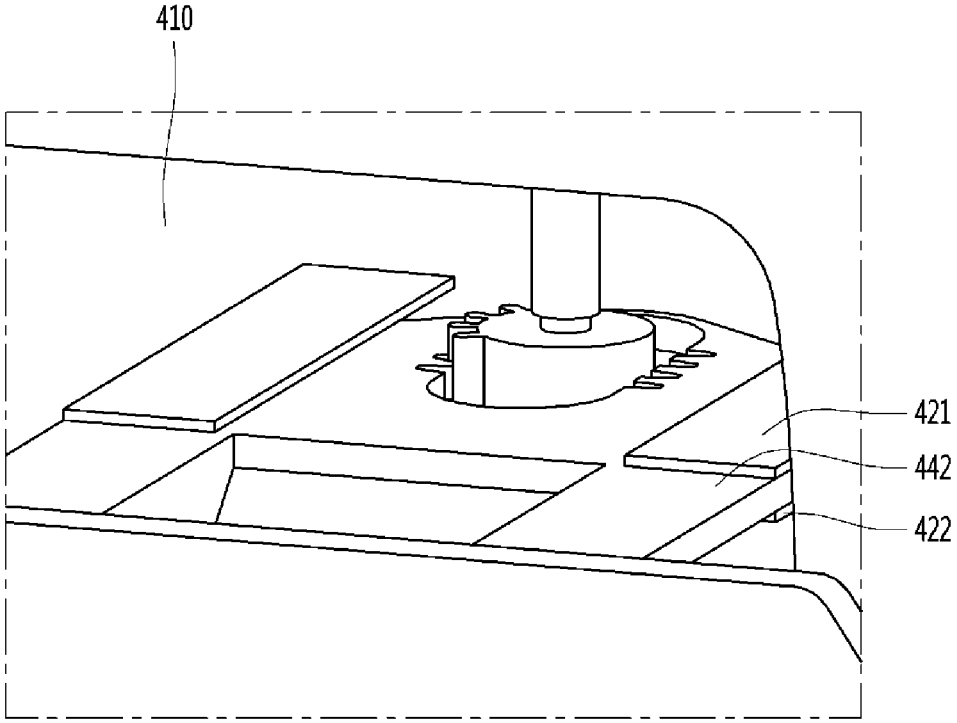
FIG. 13 is a view illustrating a first guide mechanism for guiding movement of a movable member according to an embodiment.

An operation of the power transmission part will be described with reference to the drawings. FIG. 13 is a view illustrating a first guide mechanism for guiding movement of the movable member according to an embodiment, and FIG. 14 is view illustrating a second guide mechanism for guiding movement of the movable member according to an embodiment.

First, referring to FIG. 13, the nozzle body 410 may have a first guide mechanism 421 and 422 which may guide the linear motion (forward and backward movement in the embodiment) of the movable member 440. The first guide mechanism 421 and 422 may include a first guide rib 421, and a second guide rib 422 which may be vertically spaced apart from the first guide rib 421. A part of the first member 442 may be located between the first guide rib 421 and the second guide rib 422. Therefore, the movable member 440 may stably perform the linear motion, while located between the first guide rib 421 and the second guide rib 422. That is, in the embodiment, the first guide mechanism 421 and 422 may serve as a guide rail.

Figure 14:
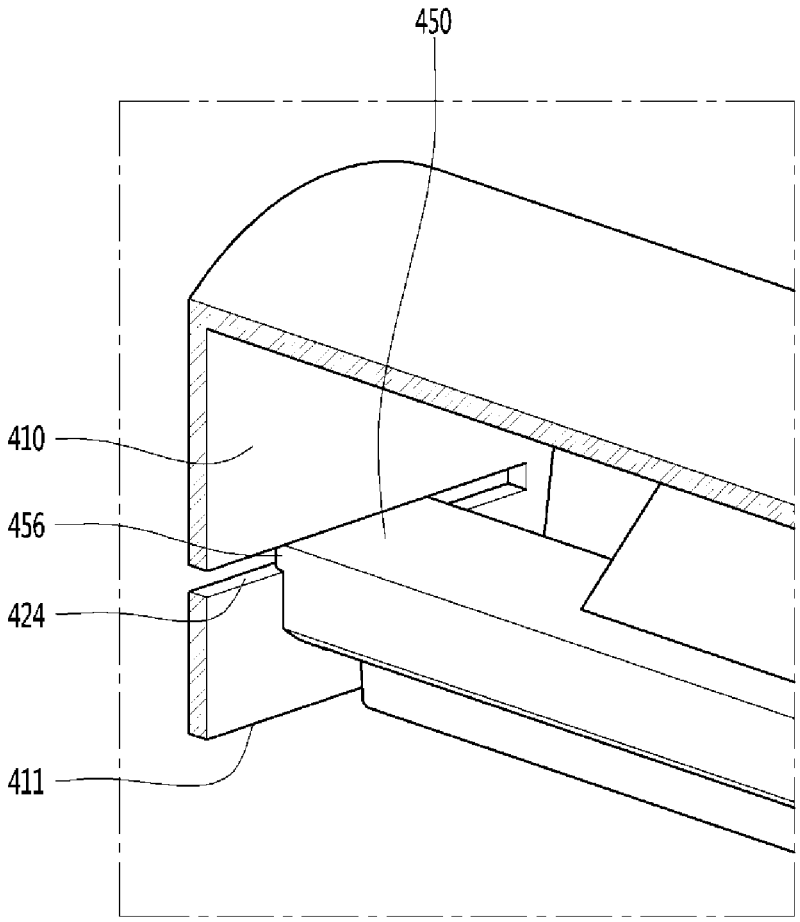
FIG. 14 is view illustrating a second guide mechanism for guiding movement of the movable member according to an embodiment.

Referring to FIG. 14, the nozzle body 410 may have a second guide mechanism 424 which may guide the linear motion of the movable member 440. For example, the second guide mechanism 424 may be a groove provided at the nozzle body 410. The movable member 440 may have a guide protrusion 456 which may be accommodated in the groove. For example, the guide protrusion 456 may be provided at the second member 450. As another example, like the second guide mechanism, the first guide mechanism may be a groove which may accommodate a part of the movable member. Alternatively, like the first guide mechanism, the second guide mechanism may include a plurality of guide ribs which may be vertically spaced apart from each other.

Figure 19:
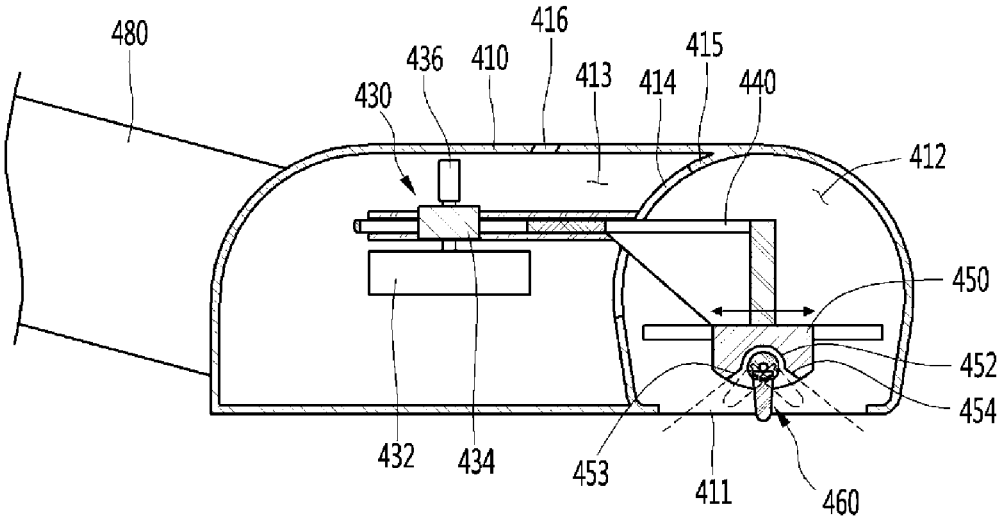
FIG. 19 is a cross-sectional view illustrating a state in which a brush member of a cleaning part is caused to reciprocate by a driver according to an embodiment.

FIGS. 15 to 18 are views illustrating an operation of the power transmission part according to an embodiment, and FIG. 19 is a cross-sectional view illustrating a state in which the brush member of the cleaning part is caused to reciprocate by the driving unit according to an embodiment. Referring to FIGS. 15 to 19, the accommodation part 443 of the movable member 440 may further include a first space 443*a* and a second space 443*b* in which the rotational part 434 may be located while being rotated. The rotational part 434 may be located between the first space 443*a* and the second space 443*b* and between the first gear part 444 and the second gear part 445.

Figure 15:
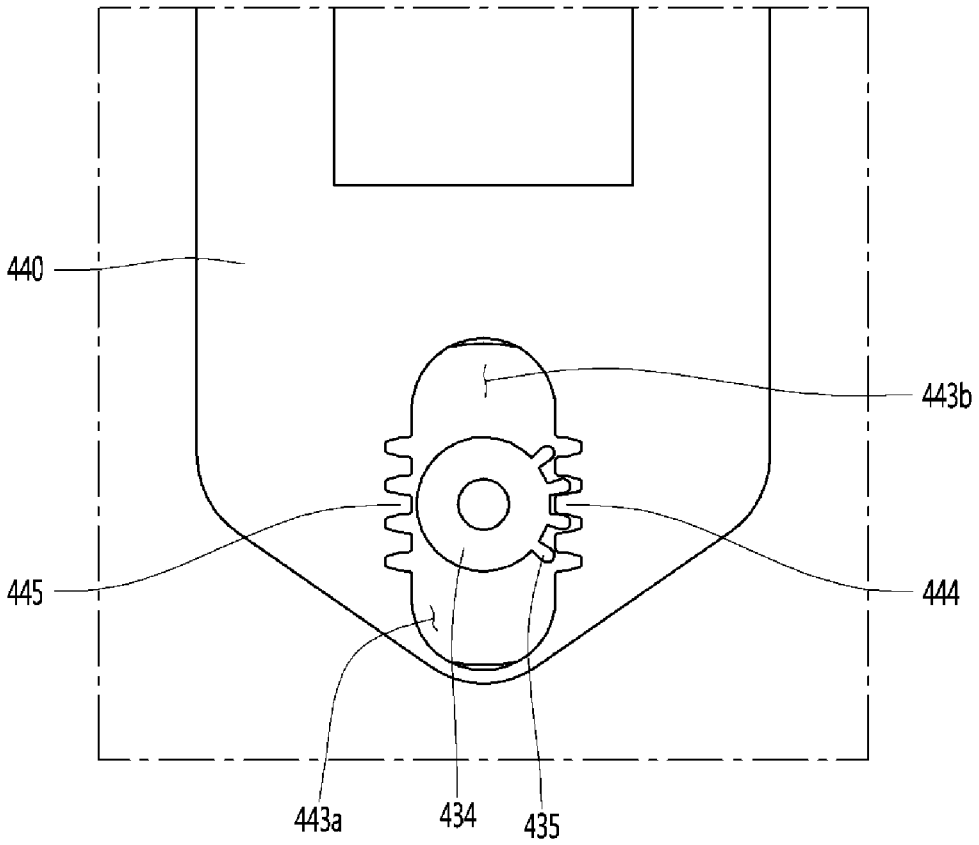
FIGS. 15 to 18 are views illustrating an operation of the power transmission part according to an embodiment.
Figure 16:
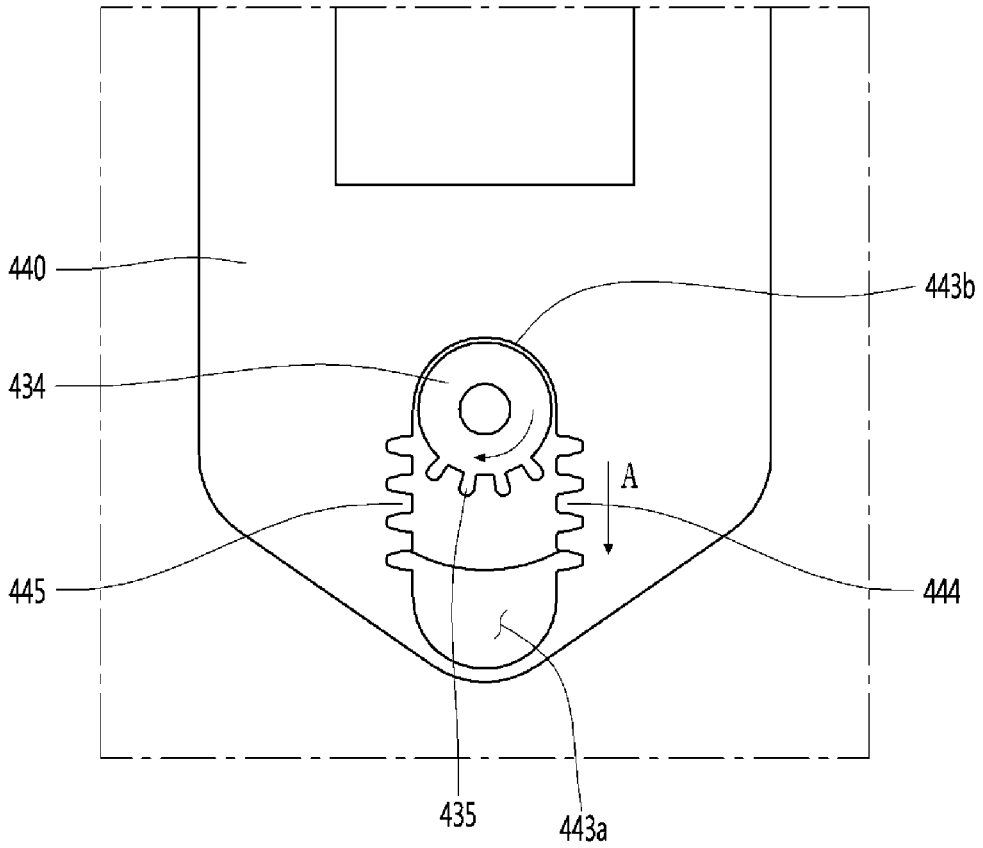

As illustrated in FIG. 15, the gear teeth 435 of the rotational part 434 may be engaged with the first gear part 444. In this state, when the rotational part 434 is rotated clockwise, the rotational force of the rotational part 434 may be transmitted to the first gear part 444 by the gear teeth 435, as illustrated in FIG. 16, and the movable member 440 may perform the linear motion in an A direction. As the movable member 440 may perform the linear motion in the A direction, and the rotational part 434 may be rotated, a part of the rotational part 434 may be located in the second space 443*b*. Engagement between the gear teeth 435 of the rotational part 434 and the first gear part 444 may be released.

Figure 17:
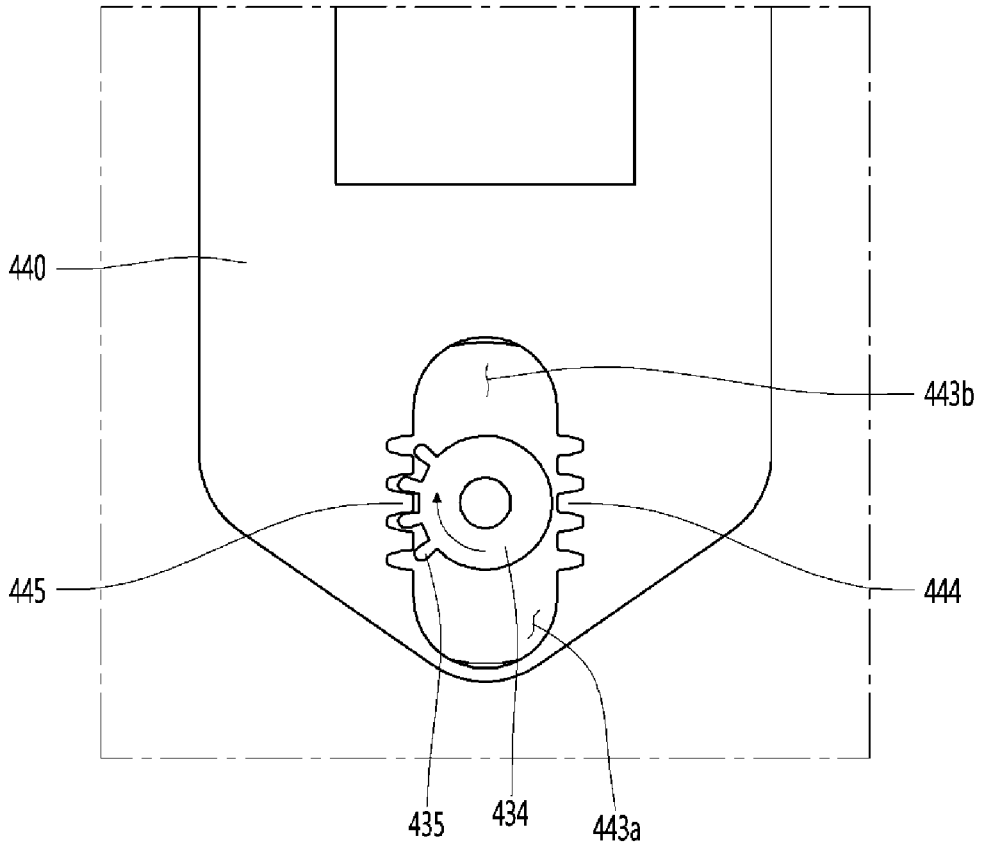
Figure 18:
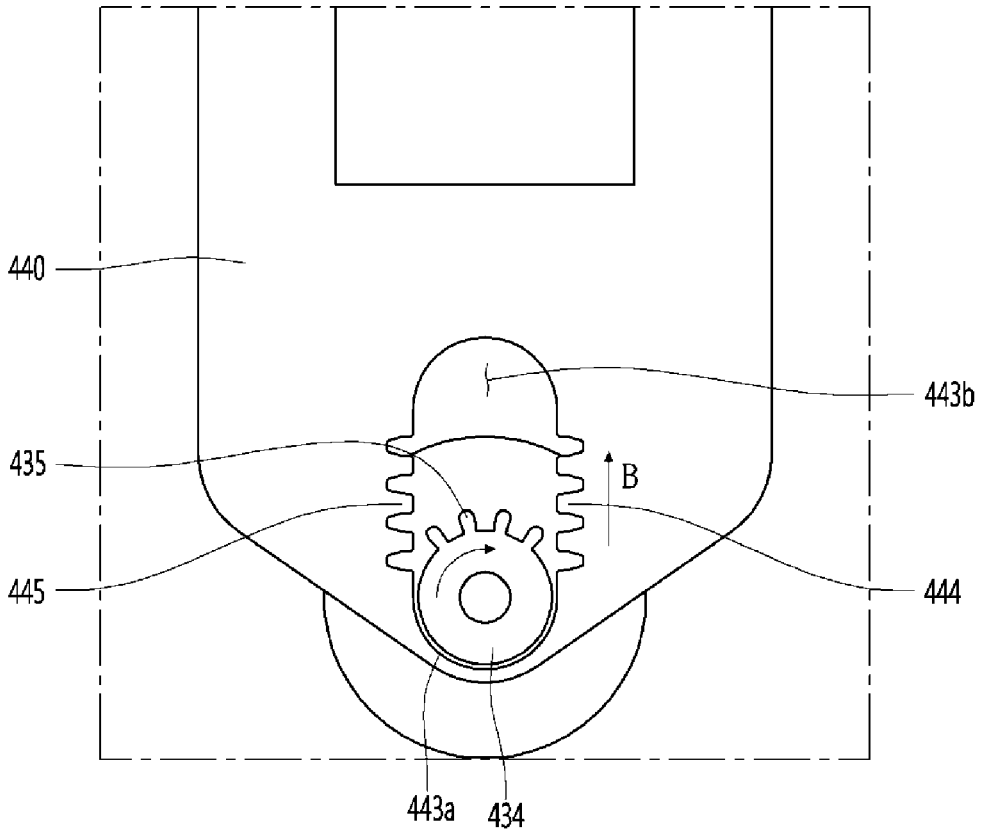

In a state illustrated in FIG. 16, when the rotational part 434 is further rotated clockwise, the movable member 440 may be maintained in a stopped state until the gear teeth 435 of the rotational part 434 may be engaged with the second gear part 445. When the rotational part 434 is further rotated clockwise, the gear teeth 435 of the rotational part 434 may be engaged with the second gear part 445, as illustrated in FIG. 17. In a state illustrated in FIG. 17, when the rotational part 434 is further rotated clockwise, the rotational force of the rotational part 434 may be transmitted to the second gear part 445 by the gear teeth 435, and the movable member 440 may perform the linear motion in a B direction opposite to the A direction.

As the movable member 440 performs the linear motion in the B direction and the rotational part 434 is rotated, a part of the rotational part 434 is located in the first space 443*a*. Engagement between the gear teeth 435 of the rotational part 434 and the second gear part 445 may be released. In a state illustrated in FIG. 18, when the rotational part 434 is further rotated clockwise, the movable member 440 may be maintained in the stopped state until the gear teeth 435 of the rotational part 434 are engaged with the first gear part 444.

In brief, in the state illustrated in FIG. 15, while the rotational part 434 is rotated clockwise 360 degrees and returned to a position of FIG. 15, the movable member 440 may perform the linear reciprocation motion once. As the movable member 440 performs the linear reciprocation motion, the brush member 464 of the cleaning part 460 may reciprocate at least once. As the brush member 464 reciprocates at least once, the brush member 464 may clean the floor surface facing the suction port 411 at least twice. As the brush member 464 reciprocates, a speed of the brush member 464 may have a maximum value when the brush member 464 is in contact with the floor surface, and thus the dust on the floor surface may be effectively swept up by the brush member 464.

According to an embodiment, when the rotational part 434 or the shaft of the motor is rotated once, the brush member 464 may clean the floor surface at least twice. Therefore, a speed of the drive part 432 may be reduced, and thus a power consumption of the drive part 432 may be reduced.

Figure 20:
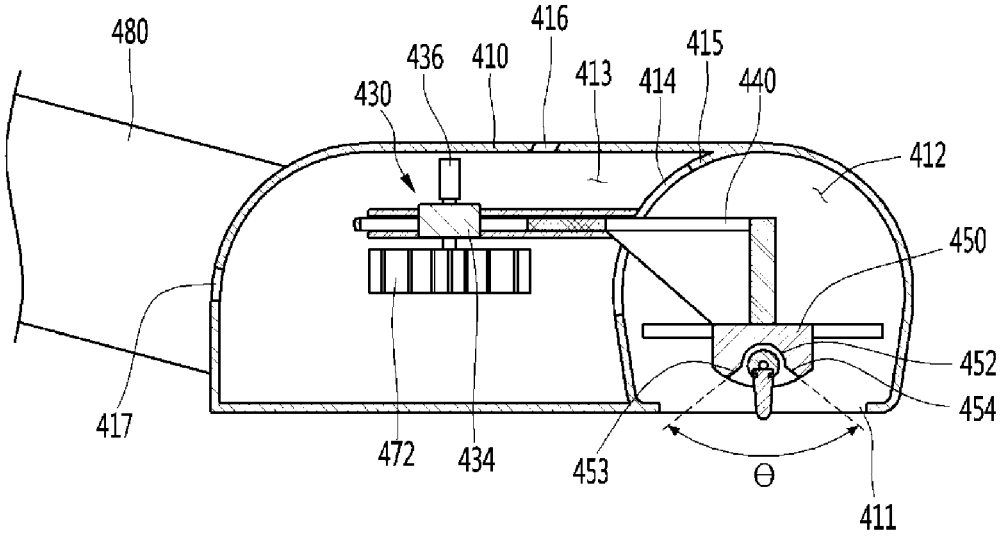
FIG. 20 is a cross-sectional view illustrating a suction nozzle according to an embodiment.

FIG. 20 is a cross-sectional view illustrating a suction nozzle according to an embodiment. This embodiment may be the same as a previous embodiment except for the type of the drive part. Therefore, hereinafter, only a characteristic part of this embodiment will be described.

Referring to FIG. 20, a drive unit or device 430 according to an embodiment may include a drive part 472 which may be rotated by a flow of the air suctioned through the suction port. The drive part 472 may be a turbine having a plurality of blades. In general, when the turbine is used as the driving part, a rotational speed of the turbine may be increased as a size of the turbine is increased.

According to an embodiment, even when the rotational speed of the drive part 472 decreases, cleaning performance may be maintained as described in the above-described embodiment, and thus the size of the turbine may be reduced. Accordingly, a size of the suction nozzle may be reduced. To enable the turbine to be easily rotated, the nozzle body 410 may further have an additional suction port 417 that may suction the air toward the turbine. The additional suction port 417 may be located at a rear side of the nozzle body 410.

In the above-described embodiments, the power of the drive part 372 or 472 has been described as being directly transmitted to the rotational part. However, unlike this, the power of the drive part 372 or 472 may be transmitted to the rotational part by one or more gears or belts. In this case, a degree of arrangement freedom of the drive part may be enhanced, and a length of the movable member in a forward and backward direction may be reduced.

Also, the drive unit 430 may be applied to any embodiment. In this case, the second cleaning part and the third cleaning part may perform the linear reciprocation motion within a predetermined range, and may automatically be reciprocated by the drive unit 430. In this case, the drive unit 430 may be provided at the suction part, and the movable member may be connected to one or more stoppers of the second cleaning part and the third cleaning part.

Embodiments disclosed herein are directed to a nozzle for a cleaner in which an area of a suction nozzle having a brush may be able to be varied, and a brush cleaning unit or device having a variable width corresponding to the variable suction nozzle is provided, and a vacuum cleaner.

According to an embodiment, there is provided a nozzle for a cleaner, including a suction part having a suction port and a main brush; and a movable member movably installed at the suction part and having a subsidiary brush. The movable member may be slidably connected to the suction part, and a brush slit which prevents interference with the subsidiary brush while the movable member is slid may be provided at the suction part. The movable member may have a communication hole which is in communication with the suction port when inserted into the suction part. The movable member may include a first movable member which is disposed at one side of the suction part, and a second movable member which is disposed at a side of the suction part opposite to the first movable member. The movable member may perform a linear reciprocation motion within a predetermined range.

The nozzle may further include a brush cleaning unit which is connected to the movable member, through which the main brush and the subsidiary brush pass, and which separates foreign substances attached to one or more of the main brush and the subsidiary brush. The brush cleaning unit may be moved along with the movable member, and a length thereof may be varied while the movable member is moved. The brush cleaning unit may include a first cleaning part through which the main brush passes, and a second cleaning part which is movably installed at the first cleaning part and through which the subsidiary brush passes.

One of the movable member and the second cleaning part may have a guide part which is inserted into the other one to guide movement of the brush cleaning unit in a direction which parallel to an extension direction of the main brush. The nozzle may further include a guide part stopper which prevents the guide part from separating from the movable member or the second cleaning part.

A first brush slit which is formed by cutting a part of the suction part and prevents interference with the subsidiary brush may be formed at the suction part. A second brush slit which prevents the interference with the subsidiary brush may be formed at the first cleaning part, and a third brush slit which prevents the interference with the main brush may be formed at the second cleaning part. An opening communicates with the suction part may be provided at the first cleaning part. A communication hole which communicates with the opening when the second cleaning part is inserted into the first cleaning part may be formed at the second cleaning part.

The nozzle may include a lever which is movably provided at the suction part, and a transmission part which transmits an operational force of the lever to the brush cleaning unit. The nozzle may further include a driver which moves the movable member.

According to another embodiment, there is provided a vacuum cleaner including a cleaner body having a suction motor; and a suction nozzle which communicates with the cleaner body and suctions air on a floor surface. The suction nozzle may include a suction part having a suction port and a main brush; and a movable member movably installed at the suction part and having a subsidiary brush. The suction nozzle may further include a brush cleaning unit which is connected with the movable member, is movable along the movable member, and cleans the main brush and the subsidiary brush. A length of the brush cleaning unit may be varied while the movable member is moved with respect to the suction part. The movable member may perform a linear reciprocation motion within a predetermined range. A brush slit which prevents interference with the subsidiary brush while the subsidiary brush is moved may be formed at the suction part.

In the above description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Even though all the elements of the embodiments are coupled into one or operated in the combined state, the present disclosure is not limited to such an embodiment. That is, all the elements may be selectively combined with each other without departing the scope of the disclosure. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the disclosure as defined by the appended claims. Therefore, the preferred embodiments should be considered in descriptive sense only and not for purposes of limitation, and also the technical scope of the disclosure is not limited to the embodiments. Furthermore, is defined not by the detailed description of the disclosure but by the appended claims, and all differences within the scope will be construed as being comprised in the present disclosure.

What is claimed is:

1. A nozzle for a cleaner, comprising:

a main body having a suction port and a plurality of main brushes;

at least one movable body coupled to the main body and having at least one subsidiary brush, wherein the at least one movable body extends and retracts from the main body, and the at least one subsidiary brush is positioned between two adjacent main brushes when the at least one movable body is retracted; and a brush cleaning device that separates foreign substances attached to one or more of the plurality of main brushes, wherein the brush cleaning device is connected to the at least one movable body, and wherein the plurality of main brushes passes through the brush cleaning device.

2. The nozzle according to claim 1, wherein the at least one movable body is slidably connected to the main body, and wherein a brush slit is provided at the main body that prevents interference between the at least one subsidiary brush and the main body while the at least one movable body is slid.

3. The nozzle according to claim 2, wherein the at least one movable body has a communication hole that communicates with the suction port when the at least one movable body is inserted into the main body.

4. The nozzle according to claim 1, wherein the at least one movable body includes a first movable body provided at a first side of the main body, and a second movable body provided at a second side of the main body opposite to the first movable body.

5. The nozzle according to claim 1, wherein the at least one movable body performs a linear reciprocation motion within a predetermined range.

6. The nozzle according to claim 1, wherein the at least one subsidiary brush passes through the brush cleaning device.

7. The nozzle according to claim 6, wherein the brush cleaning device is moved along with the at least one movable body in a first direction substantially perpendicular to an extension direction of the plurality of main brushes and a second direction opposite the first direction, such that a length of the brush cleaning device in the first and second directions is varied while the movable body is moved in the first and second directions.

8. The nozzle according to claim 7, wherein the brush cleaning device includes a first cleaning part through which the plurality of main brushes pass, and a second cleaning part movably installed at the first cleaning part and through which the at least one subsidiary brush passes.

9. The nozzle according to claim 8, wherein one of the movable body and the second cleaning part has a guide part inserted into the other of the movable body and the second cleaning part to guide movement of the brush cleaning device in a third direction parallel to the extension direction of the plurality of main brushes.

10. The nozzle according to claim 9, wherein the guide part may not be separated from the movable body or the second cleaning part.

11. The nozzle according to claim 8, wherein a first brush slit is formed at the main body by cutting a part of the main body and wherein the first brush slit prevents interference between the at least one subsidiary brush and the main body.

12. The nozzle according to claim 8, wherein a second brush slit which prevents interference between the at least one subsidiary brush and the main body is formed at the first cleaning part, and a third brush slit which prevents interference between the plurality of main brushes and the main body is formed at the second cleaning part.

13. The nozzle according to claim 8, wherein an opening that communicates with the main body is provided at the first cleaning part, and a communication hole that communicates with the opening when the second cleaning part is inserted into the first cleaning part is formed at the second cleaning part.

14. The nozzle according to claim 6, further including a lever movably provided at the main body that transmits an operational force to the brush cleaning device.

15. The nozzle according to claim 1, further including a at least one stopper which moves the movable body.

16. A vacuum cleaner comprising:

a cleaner body; and a suction nozzle that communicates with the cleaner body and suctions air on a floor surface, wherein the suction nozzle includes a suction part having a suction port and a main brush;

at least one movable body movably installed at the suction part and having a subsidiary brush; and a brush cleaning device connected to the at least one movable body, wherein the brush cleaning device is movable along with the at least one movable body in a first direction substantially perpendicular to an extension direction of the main brush and a second direction opposite the first direction and cleans the main brush and the subsidiary brush.

17. The vacuum cleaner according to claim 16, wherein a length of the brush cleaning device is varied in the first and second directions while the at least one movable body is moved in the first and second direction with respect to the suction part.

18. The vacuum cleaner according to claim 16, wherein the at least one movable body performs a linear reciprocation motion within a predetermined range.

19. The vacuum cleaner according to claim 16, wherein a brush slit is formed at the suction part that prevents interference between the subsidiary brush and the cleaner body while the subsidiary brush is moved.

20. A nozzle for a cleaner, comprising:

a main body having a suction port and a plurality of main brushes mounted on a bottom surface of the main body;

at least one movable body coupled to the main body having at least one subsidiary brush, wherein the at least one movable body is inserted in the main body, and the at least one subsidiary brush is positioned between two adjacent main brushes when the at least one movable body is inserted in the main body; and a connection tube rotatably connected to the main body, wherein a brush slit is provided at the bottom surface of the main body that prevents interference between the at least one subsidiary brush and the main body while the at least one movable body is slid.

* * * * *